US005104340A

United States Patent [19]

Elam et al.

[11] Patent Number: 5,104,340

[45] Date of Patent: Apr. 14, 1992

[54] CORROSION RESISTANT ELECTRICAL CONNECTOR

[76] Inventors: Gary J. Elam, 4336 Chickasaw Dr., Huntsville; Johnny F. Jenkins, Route 3, Box 17-1, Elkmont; Mark J. Chatham, 610 High Street, Hartselle, all of Ala.

[21] Appl. No.: 498,218

[22] Filed: Mar. 22, 1990

[51] Int. Cl.[5] ..... H01R 13/52

[52] U.S. Cl. ..... 439/604; 439/932; 439/936

[58] Field of Search ..... 439/936, 319, 271–276, 439/277, 278–282, 587, 589, 736, 604–606, 598, 932; 29/858, 883

[56] References Cited

U.S. PATENT DOCUMENTS

| | | | |
|---|---|---|---|
| 2,655,638 | 10/1953 | Allen | 439/589 |
| 2,700,140 | 1/1955 | Phillips | 439/274 |
| 2,701,867 | 2/1955 | Obenschain | 439/357 |
| 3,202,956 | 8/1965 | Hennessey | 439/319 |
| 4,053,201 | 10/1977 | Grappe | 439/589 |
| 4,090,759 | 5/1978 | Herrmann, Jr. | 439/279 |

*Primary Examiner*—Neil Abrams

*Attorney, Agent, or Firm*—Thomas, Kerr, & Kayden

[57] ABSTRACT

An electrical connector for use in corrosive environments comprises a pair of opposed housings with male and female connectors respectively disposed therein, the connectors being disposed in a dielectric insulator. Conductive leads are secured to the connectors and are encased in a layered resinous material with a dam formed between the resinous material and the insulators. The connector is designed for quick connection and disconnection preferably utilizing a bayonet type mount.

8 Claims, 3 Drawing Sheets

CORROSION RESISTANT ELECTRICAL CONNECTOR

TECHNICAL FIELD

The present invention relates to electrical connectors and particularly to electrical connectors for use in corrosive nuclear environments.

BACKGROUND OF THE INVENTION

The use of quick release electrical couplers or connectors to mate electrical conductors to other conductors or to related equipment has long been a practice in the electronics industry. Such connectors generally include a male plug assembly and a female receptacle assembly with the plug assembly being provided with conducting pins adapted to be received into corresponding conducting sockets of the female receptacle assembly. The pins and sockets, in turn, are coupled to conductors that extend rearwardly from the plug and receptacle for coupling to a cable or a bus bar. Locking means are also often provided for releasably locking the male plug and female receptacle assemblies together with their pins and sockets electrically mated therein.

While such connectors have attained widespread success in the electronics industry in general for providing a quick and convenient means of coupling and decoupling cables from other cables or from electrical equipment, their use has largely been avoided in highly corrosive environments such as those often encountered in a nuclear generating station. This is true for several reasons. Under normal conditions, electrical connectors in such environments can be subjected to high doses of radiation as well as considerable heat and moisture often in the form of super heated steam. Further, this moisture and steam usually contains other corrosive chemicals such as sodium nitrate or boron compounds rendering the environment even more hostile. After periods of exposure to such environments, materials used in common connectors tend to break down permitting entry of corrosive materials into the interior of the connector and ultimately into related electronic equipment which can result in the failure of such critical devices as radiation monitors, fans and pumps.

Some attempts to provide sealed electrical connectors for use in highly corrosive nuclear environments have heretofore been made as illustrated in U.S. Pat. No. 4,795,360 of Newman. While such connectors have been somewhat successful, they nevertheless have tended to exhibit critical inherent limitations and shortcomings that make them less than desirable under many circumstances. The Newman device, for example, comprises a male plug and female receptacle that each has an outer housing surrounding the internal matable pins and sockets. The pins and sockets are embedded in their respective housings in a unitary insulative epoxy resin that serves to secure them in their proper mating positions and insulate them from each other. Further, the epoxy is formulated to bond to the interior surface of the housings and to the exterior surfaces of the pins, sockets and related conductors in an effort to prevent migration of corrosive moisture from the environment along the conductors and to the connecting pins and sockets within the connector. While it is critical to such devices that the epoxy bond to the connector elements as described, it is often the case that a poor bond is created when the epoxy is poured or that the epoxy breaks down or becomes brittle after long exposure to corrosive elements or radiation such that a path for corrosive moisture is created either along the epoxy-housing interface or the epoxy-conductor interface. These devices typically, therefore, have incorporated elaborate housing and conductor configurations that include barrages of baffles and other means designed to prevent moisture migration into the connector when the epoxy brakes down. The specialized design and construction of such components also adds greatly to the cost of such connectors.

Thus, a continuing and yet unaddressed need exists for an electrical connector for use in nuclear corrosive environments that is conveniently and economically manufacturable and that reliably prevents migration of corrosive moisture to the interior elements of the connector without elaborate specialized configurations. It is to the provision of such a connector that the present invention is primarily directed.

SUMMARY OF THE INVENTION

It is therefore one cf the principal objects of the present invention to provide an electrical connector that is resistant to corrosive environments while providing superior conductivity through a layered construction.

Another object of the present invention is to provide a connector that is quickly and easily connected and disconnected in the field and which is configured for convenient and economical construction.

The invention relates to an electrical connector for use in nuclear power plants or other corrosive environments having a pin housing and a socket housing comprising male and female ends respectively. Conductor means within these housings are mounted within a dielectric insulator means. A dam is provided for isolating the insulator means from the conductive leads. The ends of the conductive leads are normally soldered to auxiliary connector means and this connection is encased in a resinous material. A quick disconnect bayonet-type securing means is provided for mating the opposed housings together with a resilient means disposed therebetween for tensioning the connection.

Thus, an electrical connector for use in corrosive environments is now provided that is relatively convenient and economical to manufacture and that provides improved resistance to migration of corrosive elements into the interior of the connector without elaborate specialized configurations. These and other features, objects and advantages of the invention will become apparent upon review of the following detailed description and accompanying drawings.

DETAILED DESCRIPTION OF THE PREFERRED EMBODIMENT

Figure 1:
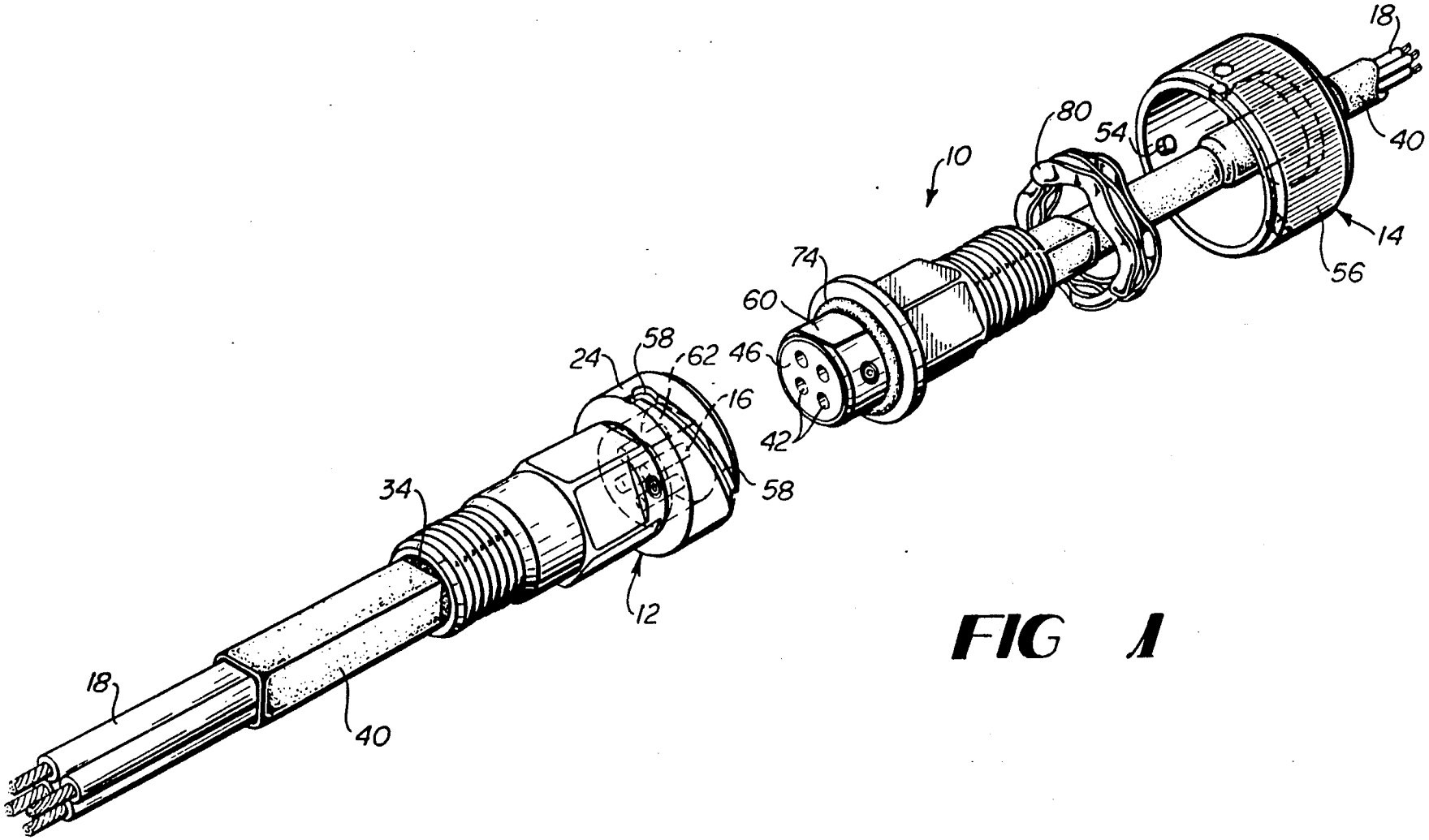
FIG. 1 is an exploded perspective view of an electrical connector that embodies principals of the invention in a preferred form.

The present invention is an electrical connector for use in corrosive nuclear environments that includes a male plug assembly and a corresponding matable female receptacle assembly. Both the plug and receptacle assemblies include preferably stainless steel metallic housings that each define a substantially cylindrical interior volume with the exterior of the housings being formed to couple together in locking relationship. Secured within the front end section of the male plug, preferably with a set screw, is a substantially cylindrical dielectric insulator that bears a set of electrically conductive connector pins extending therefrom. A similar dielectric insulator is secured within the front end of the female receptacle and bears a set of conductive sockets configured and arranged to receive the pins of the male plug in mating electrically conductive relationship when the plug and receptacle assemblies are coupled together.

A conductive pin extender is secured by solder or the like to the rear end portion of each of the pins and sockets within their respective dielectric insulators and extends rearwardly of said blocks into the interior volume of the respective male or female housing. The end of a wire conductor is in turn soldered or otherwise secured to the free ends of each pin extender within the interior volume and the wires in turn extend out the rear end of the plug and receptacle assemblies in the form of multiple conductor cables. Positioning baffles are secured about the pins and conductors within the housings to hold them in place and the volume is filled or potted with three distinct layers of epoxy resin that bonds to the housings, pins and conductors to seal against intrusion of corrosive elements. An isolating dam is sandwiched between the forward most epoxy layer and the dielectric insulators to isolate the blocks from the epoxy and provide increased integrity against corrosion intrusion.

Embedded within the rear most epoxy layer adjacent the rear end of each housing is a somewhat resilient sleeve that surrounds and tightly embraces the cable extending from the housing to prevent cracking or destruction of the epoxy as the cable is bent or otherwise manipulated. A bayonet-type locking ring is provided for releasably locking the male and female housings securely together and a O-ring within the space between the housings further seals off the interior thereof.

The dielectric insulators within the front ends of the housings provides greatly increased ease of fabrication over prior art devices in which the entire interior volume is filled with epoxy with the pins embedded therein. Further, the multi layered epoxy within the housings surrounding the conductors reduces significantly the chances of corrosive moisture migrating into the connector since if a conducting path somehow forms in one epoxy layer, for example, it is highly improbable that a corresponding aligned path with also form in an adjacent layer. The interface between adjacent epoxy layers, then, serves as barriers against moisture migration which greatly increases the integrity of the connector.

Referring now more specifically to the drawings and to FIG. 1 in particular, numeral 10 designates generally the electrical connector, the connector being shown in exploded form having a male end and a female end 14. In general, this connector is used to couple a source of power with an electrical device in a corrosive environment and/or particularly environments that include radiation, heat, moisture, or steam. The coupler may be of a quick disconnect bayonet type, or may be secured together with, for example, a threaded type connection utilizing a hex nut. Briefly described, the invention connects a plurality of contact pins with corresponding contact sockets, the connection being made within a sealed environment that is designed to withstand extremes of temperature, moisture, radiation, and the like.

Figure 3:
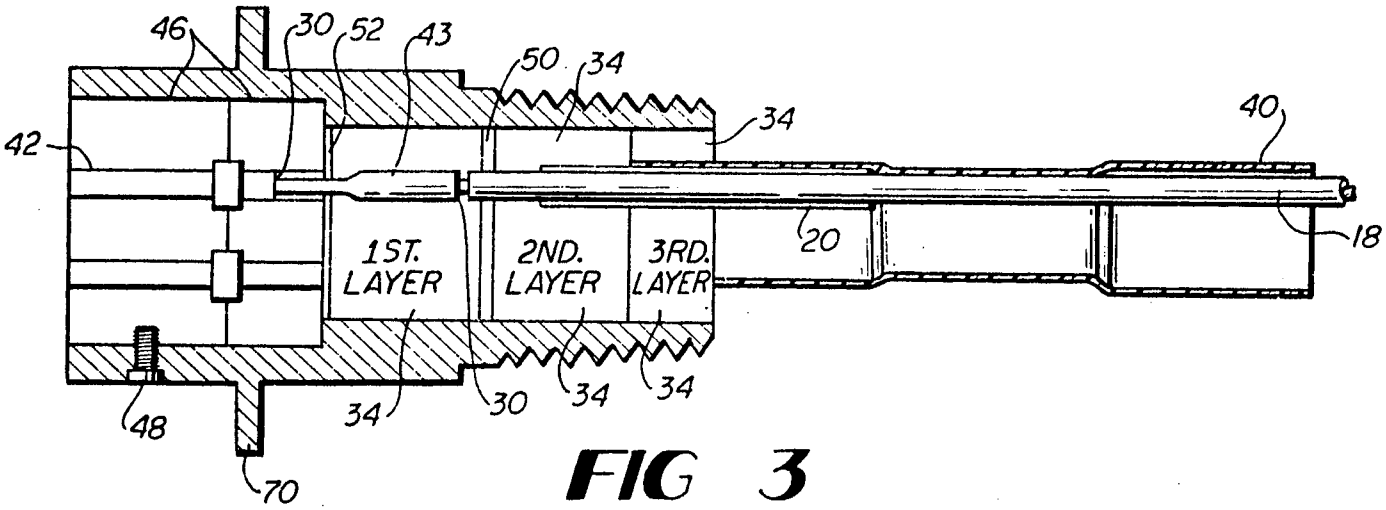
FIG. 3 is a cross-sectional view of the female plug assembly illustrating internal elements thereof.
Figure 4:
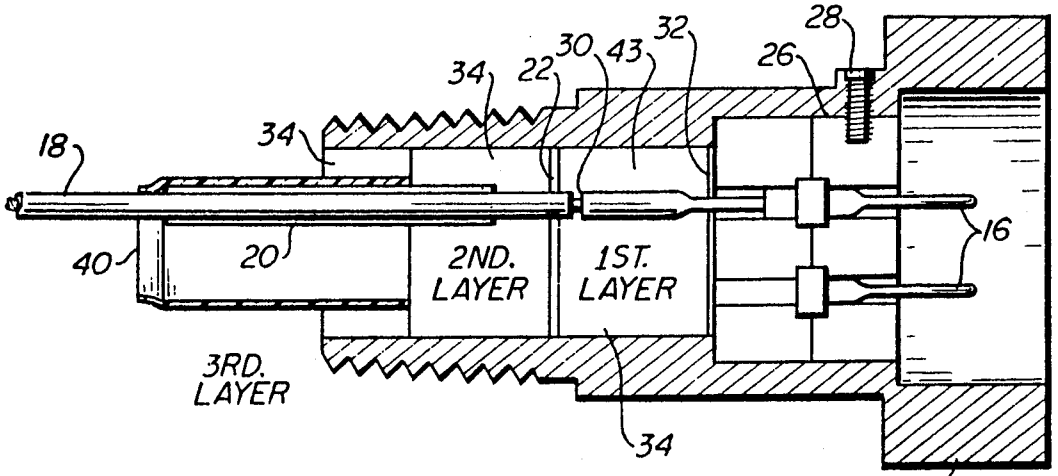
FIG. 4 is a cross-sectional view of the male receptacle assembly showing internal elements thereof.

In constructing the present invention, the male pins 16 and the female sockets 42 are soldered onto pin extenders 43 which are in turn soldered to the conductors 18 utilizing 60/40 or 63/37 resin core solder, as shown in FIG. 4. Heat shrink tubing 20 is then placed over the plurality of conductors 18 and is secured out of the way. A wafer 22 is then placed around the conductors, to space the conductors equally and to hold them in a fixed position. The housing 24 of the male side 12 is then placed around the spaced conductors and the pins are disposed within an insulator 26 which is held in place by a set screw 28. The set screw serves to hold the insulator in place and to prevent its movement as the connector is sealed. The set screw itself is sealed with a silicone resin or like material. A similar silicone resin material 32 (FIG. 4) and 52 (FIG. 3) is applied against the interior end of the insulators, thereby forming a dam for receiving a epoxy resin and isolating the insulator from the resin and the conductive leads 18. The ends of the pins, which project from the insulator toward the conductors, are then sealed in placed with a suitable epoxy that is normally applied in a three layer process. The first layer 34 is applied between the dam and the spacing wafer 22 with a syringe or like dispenser. A suitable epoxy is available from Emerson Cummings and is known as Stycast 2651-40 resin. As shown in FIGS. 3 and 4, the first layer of said resin encompasses and seals the soldered portion where the pin extenders 43 are soldered to the conductor wire 18 at points 30. This layering of epoxy, called potting, is done in layers to prevent moisture passages, if any, from being continuous throughout the connector. Thus, the epoxy is poured in three distinct layers as illustrated for the pin side and the socket side in FIGS. 3 and 4. This arrangement obviates the need to bind the insulators to the housings, the insulator being held by the respective set screw and a dam 32 and 52 which is applied between the insulators and the first layer 34 of epoxy. The dam holds the potting material and prevents and leakage of potting around the retainer surface inside the potting bore. The first layer of epoxy is then allowed to cure either at room temperature or by application of heat.

When this layer has cured, a removable top wafer, (not shown) is applied to maintain the spacing between the conductors 18. The heat shrink tubing 20 which had previously been applied around the conductors is then shrunk through the application of heat thereto, an individual tube 20 being applied over each of the conductors 18. A second layer 35 of epoxy is then applied to seal around the end of the conductor and heat shrink tubing 20, the second layer 35 being approximately the same depth as the first layer 34. The second layer 35 is allowed to cure and the temporary top wafer (not shown) is removed. An outer covering of heat shrink tubing 40 is then applied over the ends of all of the conductors and shrunk into place, this tubing serving as a strain relief. A third layer 36 of epoxy or potting is then applied to seal the conductors from the second layer 35 to the end cf the housing 24, as shown in FIGS. 3 and 4.

Referring to FIG. 3, the cross sectional view of the socket side illustrates the assembled form thereof, with assembly being essentially the same as that just described for the pin side. The sockets 42 are soldered to the extenders 43 at point 30. The sockets are then inserted into an insulator 46 which is held in place with set screw 48. The insulator is typically a thermo plastic or a ceramic, which has high temperature resistance and high dielectrical properties. A wafer 50 is then used to space and hold the conductors in place, while a dam 52 is formed, again typically from a silicone resin material. The epoxy is then layered in as previously described.

Referring again to FIGS. 1 and 2, an exploded and a connected view of the present invention is shown. The bayonet connection shown in FIG. 1 includes pins 54 projecting from the inner circumferential surface of a knurled collar 56 which surrounds the female end. The housing of the male end includes corresponding slots 58 for receiving the pins, with three separate connections being made 120° apart. Disposed between the outer edge of the female housing member and the inner most end of the collar is a wafer type spring 80 having a convoluted design. This spring applies tension to the connection and insures that the male and female ends will be held tightly together.

Figure 2:
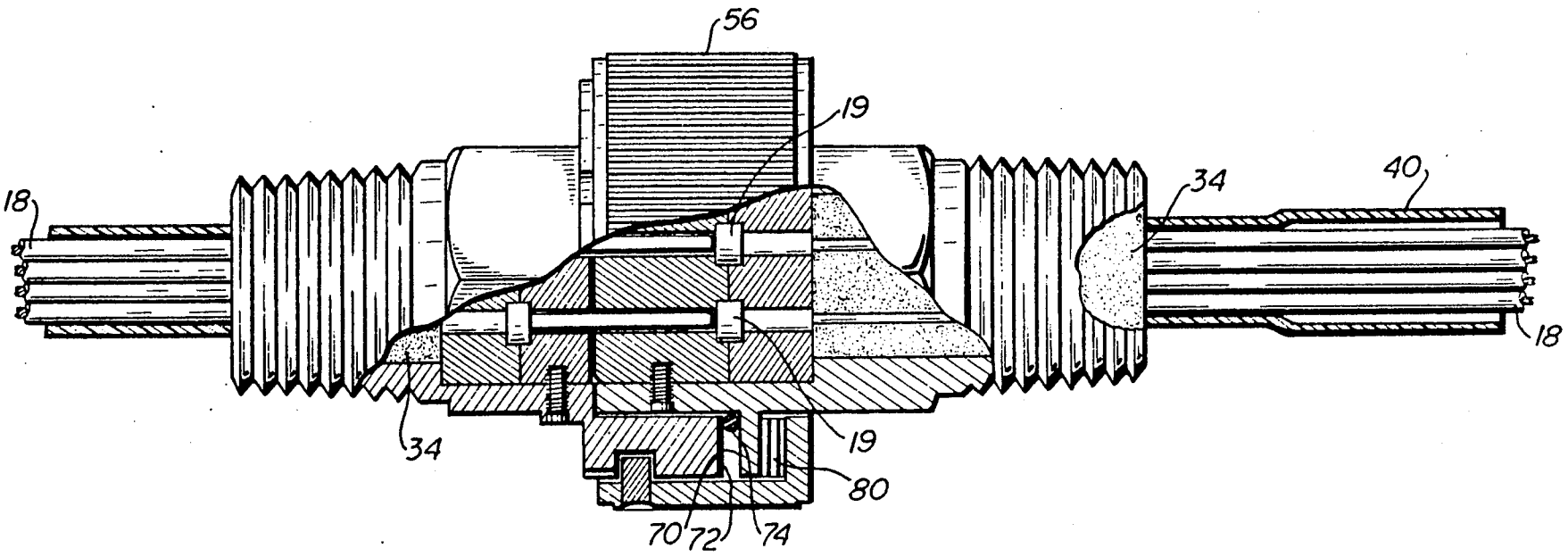
FIG. 2 is a partially sectional side elevational view of the electrical connector of FIG. 1.

The female end of the present connection has a key 60 which is received inside a key way 62 in the male or pin end, the key and key way normally being of the "D" type although other forms are of such an alignment means may be employed. The female or socket end also includes an outer flange 70 which corresponds to the outer surface 72 of the male end, with an O-ring seal 74 being received therebetween as shown in FIG. 2. This O-ring seal may be of an elastomeric material such as EPDM or it may be metal, for high temperature installations.

Thus, it can easily be seen that the present invention affords a secure means for connecting electrical components in hostile environments, the connections being easily made by hand and with a minimum of manipulation. While an embodiment of an electrical connector and variations thereof have been shown and described in detail herein, various additional changes and modifications may be made without departing from the scope of the present invention.

I claim:

1. An electrical connector for connecting conductive leads in corrosive environments with said connector comprising;

a pin housing and a socket housing each defining an interior space and having a front end and a rear end, the front end of said pin housing being adapted for mating engagement with the front end of the socket housing;

a first dielectric insulator disposed within said pin housing adjacent the front end thereof with said first insulator bearing a set of conducting pins having front and rear ends with the front ends extending therefrom in a forward direction relative to said pin housing;

a second dielectric insulator disposed within said socket housing adjacent the front end thereof with said second insulator bearing a set of conducting sockets having front and rear ends configured and arranged to receive at their front ends corresponding conducting pins of the pin housing where the housings are coupled together;

conductive leads connected to the rear ends of said conducting pins;

conductive leads connected to the rear ends of said conducting sockets;

a dam means disposed against each of said insulators in said housings and a resinous means disposed against said dam means and around the conductive leads for sealing the leads within said housing;

said resinous means comprising a plurality of sequentially arrayed individual abutting epoxy layers applied as fluent material and having interfaces between adjacent abutting layers wherein said conductive leads are encased in one of said layers at the connection to the pins and sockets; and means for connecting said housings together in mating engagement.

2. An electrical connector as defined in claim 1 in which said connector includes an elastomeric means disposed within said means for connecting said housings for tensioning the connection and maintaining secure engagement thereof.

3. An electrical connector as defined in claim 2 in which said elastomeric means is a wafer spring.

4. An electrical connector as defined in claim 1 in which said connector includes a resilient sealing means disposed between said housings upon mating engagement thereof.

5. An electrical connector for use in corrosive environments and having a longitudinal axis comprising a pair of opposed elongated housing means designed for mating engagement, one of said housing means having pin means projecting therein and the other of said housing means having socket means projecting therein and corresponding to said pin means for receiving said pin means therein, electrical insulator means disposed around said pin means and said socket means within said housings, conductive leads connected to said pin means and socket means within said housing with an epoxy means encasing the connection thereof, said epoxy means comprising a plurality of longitudinally disposed abutting layers applied as fluent material and having interfaces between abutting layers, and a dam means disposed between said epoxy means and said insulator means for isolating said connections of said conductive leads from said pin means and said socket means.

6. An electrical connector as defined in claim 5 in which said connector includes an elastomeric means disposed within said means for connecting said housings for tensioning the connection and maintaining secure engagement thereof.

7. An electrical connector as defined in claim 6 in which said elastomeric means is a wafer spring.

8. An electrical connector as defined in claim 5 in which said connector includes a resilient sealing means disposed between said housings upon mating engagement thereof.

* * * * *